US005903991A

United States Patent [19]

Sasse

[11] Patent Number: 5,903,991

[45] Date of Patent: May 18, 1999

[54] SIGN POST KIT

[76] Inventor: Winfried O. Sasse, 209 Silver Maple Dr., Chesapeake, Va. 23320

[21] Appl. No.: 09/007,820

[22] Filed: Jan. 15, 1998

Related U.S. Application Data

[63] Continuation-in-part of application No. 08/608,000, Mar. 4, 1996, abandoned.

[51] Int. Cl.[6] ..... G09F 15/00; G09F 7/22; A45F 3/44

[52] U.S. Cl. ..... 40/607; 40/617; 248/156

[58] Field of Search ..... 248/121, 156, 248/158, 159, 165, 176.1; 40/607, 617; 254/132

[56] References Cited

U.S. PATENT DOCUMENTS

| | | | |
|---|---|---|---|
| 90,559 | 5/1869 | Puller | 254/111 |
| 892,236 | 6/1908 | Eubank | 254/132 |
| 1,666,454 | 4/1928 | Johnson | 254/132 |
| 1,709,683 | 4/1929 | Pollock, Jr. | 254/132 |
| 2,377,652 | 6/1945 | Sanders | 254/132 |
| 2,424,929 | 7/1947 | Haney | 254/132 |
| 3,023,725 | 3/1962 | Boyd | 248/159 |
| 3,225,734 | 12/1965 | Bale | 248/156 |
| 3,454,252 | 7/1969 | Morgan et al. | 248/121 |
| 3,698,564 | 10/1972 | Muller | 248/159 |
| 3,779,516 | 12/1973 | King | 254/132 |
| 4,061,301 | 12/1977 | Catena | 248/156 |
| 4,064,625 | 12/1977 | Mansfield | 248/121 |
| 4,213,560 | 7/1980 | Hall | 248/156 |
| 4,249,715 | 2/1981 | Repp | 248/156 |
| 4,326,352 | 4/1982 | Barth | 40/607 |
| 4,343,449 | 8/1982 | Osthus | 248/121 |
| 4,441,679 | 4/1984 | Calet | 40/607 |
| 4,586,844 | 5/1986 | Hammonds et al. | 248/159 |
| 4,792,088 | 12/1988 | Bounell | 248/156 |
| 4,843,746 | 7/1989 | Desnoyers et al. | 40/607 |
| 4,865,283 | 9/1989 | Parker | 248/159 |
| 4,951,904 | 8/1990 | Obenshaim | 248/156 |
| 5,067,683 | 11/1991 | Wagner | 248/156 |
| 5,113,627 | 5/1992 | Jarrett, Sr. | 248/156 |
| 5,217,194 | 6/1993 | Brownell | 248/156 |
| 5,305,976 | 4/1994 | Blanchard | 40/607 |
| 5,307,580 | 5/1994 | Farmer | 248/156 |
| 5,340,065 | 8/1994 | Thomas | 40/607 |
| 5,437,423 | 8/1995 | Sinclair | 248/156 |
| 5,489,076 | 2/1996 | Thomas | 248/156 |
| 5,502,910 | 4/1996 | Lucchesi | 248/156 |
| 5,553,717 | 9/1996 | Minneman et al. | 248/156 |

FOREIGN PATENT DOCUMENTS

| | | | |
|---|---|---|---|
| 7706355 | 12/1978 | Netherlands | 248/156 |

*Primary Examiner*—Charles A. Marmor
*Assistant Examiner*—Matthew A. Kaness
*Attorney, Agent, or Firm*—Robert E. Bushnell, Esq.

[57] ABSTRACT

A sign post kit having an anchor post member is secured to the ground by a pair of stakes driven through two PVC pipes disposed in diagonally opposite corners thereof, a main post member is slid over a portion of the anchor post member and stake combination and securely snapped into place, and an arm member is snapped onto the main post member. A brochure holder is formed out of one end of the arm member and is covered by a flap. Signs are hung from the arm member or ride on top of the arm member. A flag can be inserted into a flag pole holder formed in the top the main post member or in a portion of the arm member. A stake puller jack is provided for removing the stakes from the ground.

20 Claims, 15 Drawing Sheets

SIGN POST KIT

CLAIM OF PRIORITY

This is a continuation-in-part of patent application Ser. No. 08/608,000 filed Mar. 4, 1996 abandoned.

FIELD OF THE INVENTION

The present invention relates to a sign post kit and, more particularly, to a sign post kit that is easy to assemble and disassemble, which is supported by stakes inserted into the ground, has a cross arm from which a sign can be hung, and includes a stake puller for easy removal of the stakes from the ground.

BACKGROUND OF INVENTION

Arm post signs have been in use for a very long time. This type of sign has been very effective in real estate, building, and advertising markets. These signs arc usually manufactured out of 4×4 salt treated or pressure treated lumber, and are therefore very heavy, and difficult to install and to remove. Usually a professional installer is hired for the installation and removal of such signs. The installation and removal time factor also needs to be considered. It is important to get the sign up and down as fast as possible. It becomes a burden to contact the installer, wait for the sign to be installed, then install the advertisement sign. Contact the installer again for removal, remove the advertisement sign again and wait again for the installer to remove the sign. Attempts have been made to construct light weight signs, most of which are complicated to install or have small parts, such as nuts and bolts, which are easily lost or misplaced. Ground anchoring systems are difficult to remove. Especially after the ground stake as been implanted for several month or the ground is frozen.

Brochure or flyer boxes are also being used in combination with the arm post sign, and are usually attached to the vertical main post of the sign, or are attached to the advertisement sign and hang from it in the horizontal position. These brochure boxes need be removed again before the sign can be removed by the professional installer, or such box may be damaged in transport.

Flags are often used and attached to the arm post sign. Either a bracket is screwed onto the main post of the sign, into which the flag pole is inserted. This bracket is again easily damaged in transport and easily damaged during installation. Another method is to drill a hole into the 4×4 main post, into which the flag pole is fitted. After prolonged use this drilled hole becomes loose, and the flag pole will no longer stay in place.

The continued use of such a sign can become quite expensive over a period of time.

SUMMARY OF THE INVENTION

It is therefore an object of the invention to provide a sign post kit having a cross arm member without the limitations described above. It is to be relatively in expensive, cost efficient, quick and easy to put up and easy to take down regardless of weather conditions.

It is another object of the invention to provide a sign post kit that is constructed out of light weight square pvc material, that is easily assembled and dismantled.

It is yet another object of the present invention to provide a easily assembled/disassembled a sign post kit capable of being combined with a second sign post kit using easily connectable attachments to create a new sign post display arrangement, such as a goal post sign display arrangement, of various sizes and therefore advertisement signs of smaller and larger proportions.

It is yet still another object of the present invention to provide an easily assembled sign post kit that does not use any bolts and nuts during assembly but instead is assembled through a simple method of a snap together and snap release system.

These and other objects can be achieved according to the principles of the present invention wherein an anchor post member is secured to the ground by a pair of stakes driven through a molded form, a main post member is slid over a portion of molded form disposed within the anchor post member and stake combination and may be securely snapped into place, and an arm member is snapped onto the main post member. A brochure holder is formed out of one end of the arm member and is covered by a flap. Signs are hung from the arm member or ride on top of the arm member. A flag can be inserted into a flag pole holder formed in the top the main post member or in a portion of the arm member. The various member components of the sign post and other components to be described in fuller detail below are snapped together thus obviating any need for nuts and bolts. The anchor post, main post and arm post members are formed from PVC material so that the sign post is light weight and resistant to deteriotion due to adverse weather conditions.

BRIEF DESCRIPTION OF THE DRAWINGS

A more complete appreciation of the present invention, and many of the attendant advantages thereof, will become readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
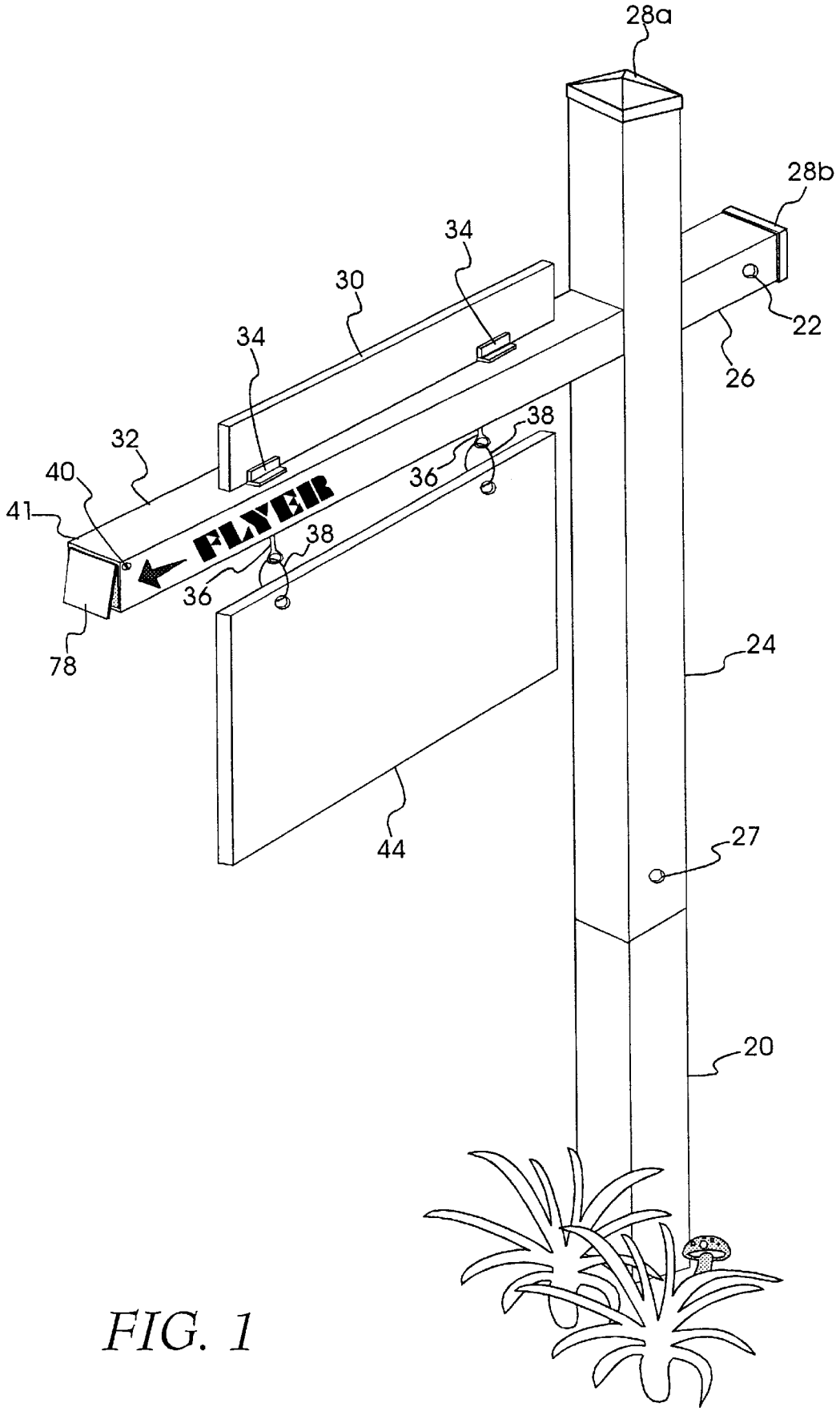
FIG. 1 is a perspective assembled view of the sign post portion of the sign post kit according to the principles of the present invention.

A more complete appreciation of the present invention, and many of the attendant advantages thereof, will become readily apparent as the same becomes better understood by reference to the following detailed description when considered in conjunction with the accompanying drawings in which like reference symbols indicate the same or similar components, wherein:

Turning now to the drawings, a perspective view showing the basic arm post sign in an assembled state is illustrated in FIG. 1. An anchor post member 20 is secured to the ground by two metal stakes (shown in FIG. 2), a main post member 24 is attached, at snap 27, to anchor member 20 and an arm member 32, extended in the horizontal direction, is attached to main post member 24. Each member (20, 24 and 32) is made out of 4×4, or 3×3 pvc. Main post member 24 one end thereof capped off by end cap 28*a* which is preferably removably attached to main post member 24. Portions of arm member 32 extend through main post member 24 and an end cap portion 26, which snaps at 22 onto arm member 32, secures arm member 32 to main post member 24. End cap portion 26 is capped off with cap 28*b* which is permanently adhered to end cap portion 26.

A sign 44 is hung below arm member 32 by rings 38, which are easy to snap open and snap closed, looped through eye bolts 36. Eye bolts 36 extend through arm member 32 and attach sign support brackets 34 to arm member 32. Note that a pair of hooks (not shown) may be used instead of rings 38, wherein the hooks would be attached to sign 44 and hooked through eye bolts 36. Sign support support brackets 34 are F shaped and serve as nuts for eye bolts 36. With sign support brackets 34 attached to arm member 32 a message rider 30 can be readily attached to extend above arm member 32.

Arm member 32 has one end thereof, i.e., a brochure box end 41, covered by a flap 78 formed in a T shape and may be made from a flexible plastic to allow for its easy insertion and removal. The arms of "T" shaped flap 78 form hinges which extend through holes 40 in arm member 32. The eye bolt 36 closest to brochure end 41 serves as a stop for brochures inserted into arm member 32 through brochure end 41. Accordingly, it is preferred to have the eye bolt 36 positioned approximately 9 inches from brochure end 41 so as to form a stop to prevent folded brochures 8.5 inches in length from sliding to far into arm member 32.

Figure 2:
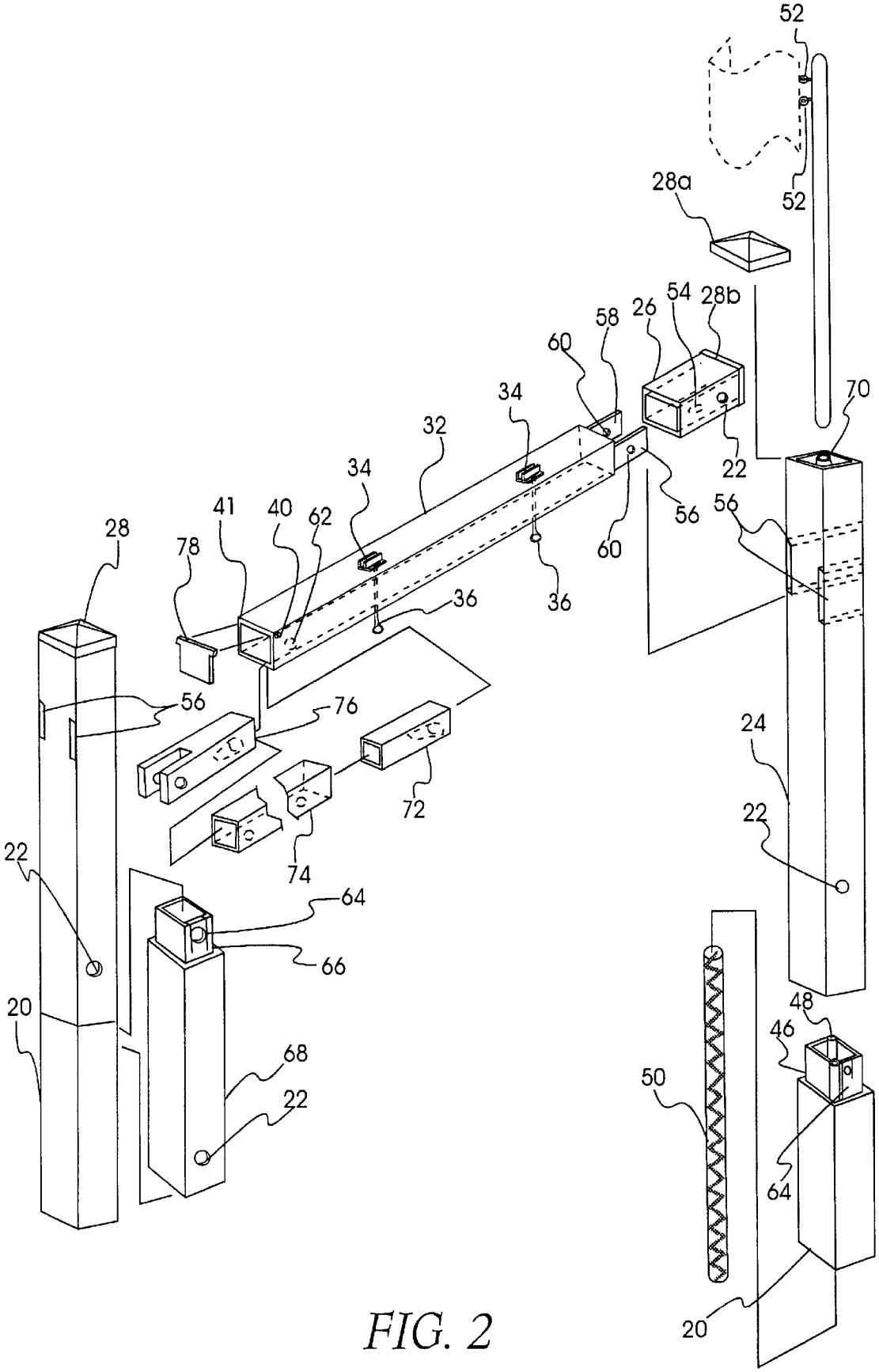
FIG. 2 is an exploded perspective view of the sign post of FIG. 1 showing additional connector pieces for creating various sign configurations.

Referring now to FIG. 2, the sign post of FIG. 1 is shown in an exploded perspective view, and additional components for expandable features of the sign post are also illustrated. A pair of stakes 50 (of which only one is shown in FIG. 2) are driven into the ground through a pair of PVC pipes 48 attached to diagonally opposite inner corners of anchor post member 20. Pipes 48 may be glued into their respective corners or may be formed during the manufacture, i.e., molding, of anchor post member 20, shown further in FIG. 7A. Stakes 50, in this embodiment, are formed of rebar metal rods and will preferably be extend into main post member 24 and be enclosed by pipes 48 which extend 6 inches into main post member 24. When disassembling the sign post, anchor post member 20 slides off stakes 50 leaving stakes 50 stuck in the ground to be removed last. A device for easily removing these stakes will be described in detail with respect to FIGS. 11–17. Additionally, in FIG. 2, a pair of 10 inch long PVC angles 46 have 4 inches thereof adhered to the inner walls of anchor post member 20 such that the corners of angles 46 fit into the unoccupied inner corners of anchor post member 20, shown further in FIG. 7A. Accordingly, the 6 inches of pipes 48 and angles 46 form a male connector extension of anchor post member 20 which slides into main post member 24. Additionally, snaps 64 are formed from angles 46 so that a nipple, or wedge, part of snaps 64 mates with holes 22 in main post member 24 when the members are properly assembled. Snaps 64 are discussed further with respect to FIGS. 5A–5C.

Arm member 32 has a pair of extensions 58 which pass through slots 56 in main post member 24. Extensions 58 each have a hole 60 which mate with wedges 54 attached to the inside walls of end cap portion 26 when properly assembled. Holes 22 in end cap portion 26 provide access to extensions 58 to enable the user to press extensions 58 inwards to disengage holes 60 and wedges 54 thereby enabling end cap portion 26 to be removed when disassembling the sign post.

As discussed earlier, cap 28*a* can be removed from main post member 24. This allows access to a PVC support pipe 70 in which a standard 53 may be inserted. Support pipe 70 is adhered to an inside corner of main post member 24. Standard 53 is shown having a pair of eyelets 52 secured thereto for supporting a flag or a banner.

Figures 10A, 10B, 10C, 10D, 10E:
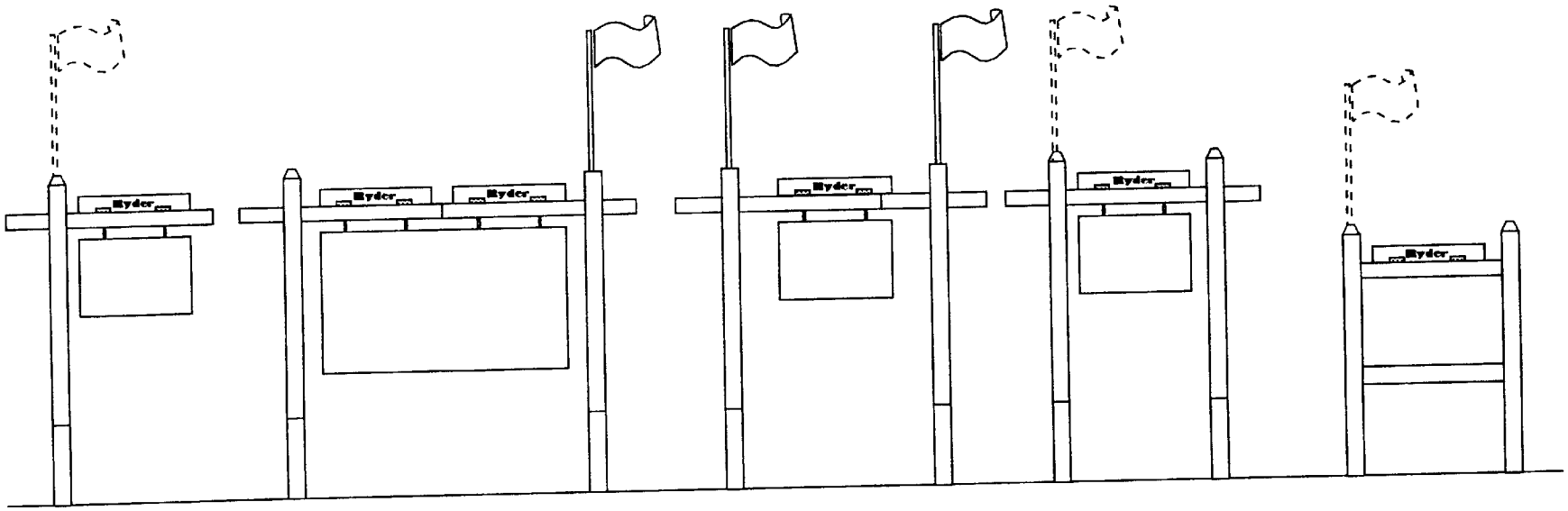
FIG. 10 illustrates several of the many variations of the assemble sign post constructed according to the principles of the present invention.

Also shown in FIG. 2 are several attachments for enabling various arrangements of the sign post to be formed. A second anchor member 20 and second main post member 24, having slots 56 therein, may be attached to brochure end 41 of arm member 32 by removing flap 78 and inserting support extension 76 which snaps, at 62, onto arm member 32, thus forming a sign post as depicted by FIG. 10D. Alternatively, the sign post can accommodate wider signs by snapping coupling extension 72 into brochure end 41, snapping an arm member extension 74 onto coupling extension 72 and snapping support extension 76 into arm member extension 74, thus forming a sign post as depicted by FIG. 10C. The size, in width, of the sign which can now be accommodated depends on the length arm member extension 74. Further shown in FIG. 2 is a post extension member 68 which snaps between main post member 24 and anchor post member 20 thus enabling the sign post to accommodate a sign of larger length.

Figure 3A:
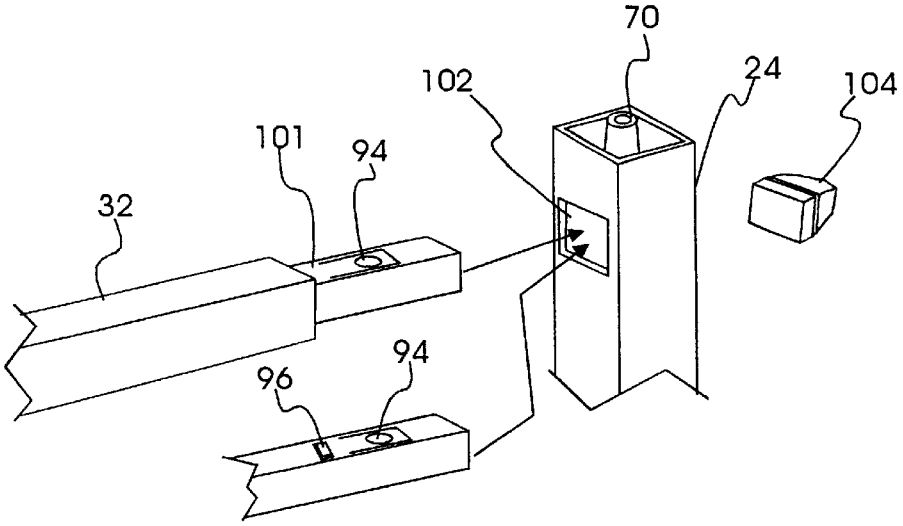
FIGS. 3A and 3B show alternate arm and post fastening systems.
Figure 3B:
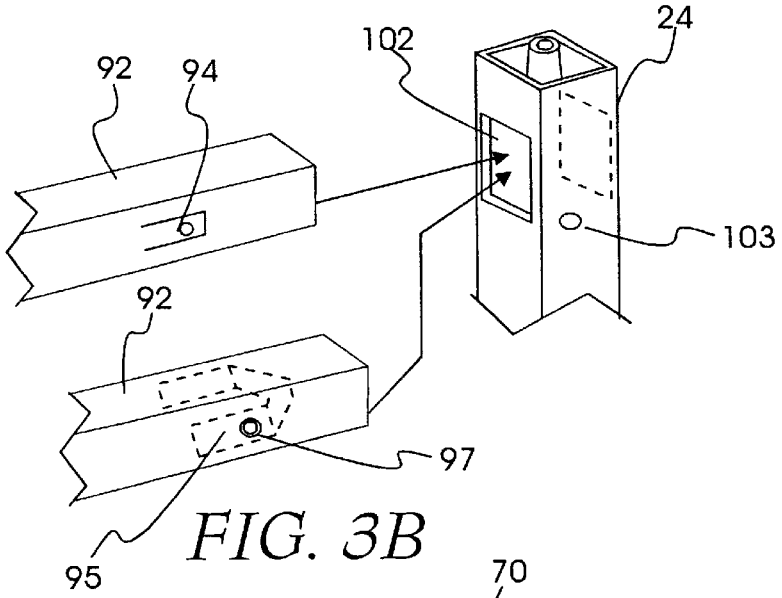
Figure 4:
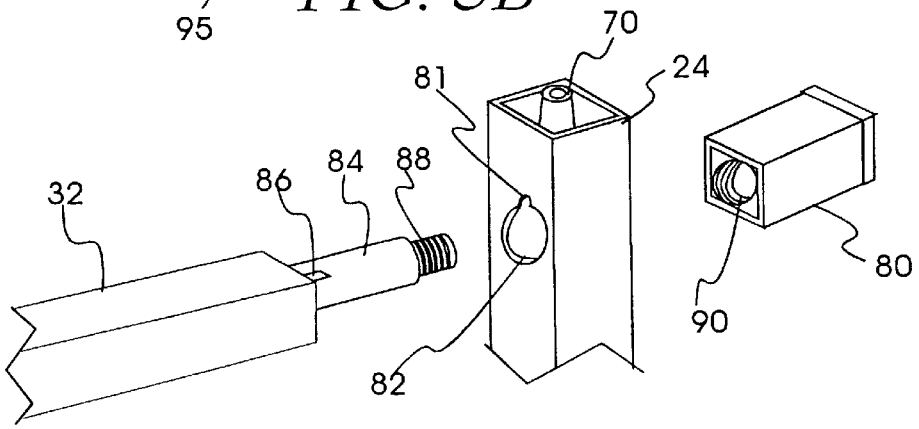
FIG. 4 shows another alternate arm and post fastening system.

FIGS. 3A, 3B and 4 illustrate alternative embodiments for arm member 32 and its connection to main post member 24. As shown in FIG. 3A, arm member 32 has a square support extension 101 which passes through a square hole 102 in main post member 24 and is secured to main post member 24 by snap 94. In this embodiment, support extension 101 is glued to the inside walls of arm member 32. Alternatively, there is also shown in FIG. 3A an arm member 92 having a snap 94 and a stop block 96. Arm member 92 is the same size as hole 102 in main post member 24, thus stop 96 prevents arm member 92 from being pushed too far through hole 102. Snaps 94 secure their respective arm members to main post member 24 without the need to use nuts and bolts. An end cap 104 closes off the end of support extension 101 or the end of arm member 92.

In FIG. 3B arm member 92 has snaps 94 in the side instead of on to as in FIG. 3A. Accordingly, main post member 24 has a hole 103 which mates with snap 94 when arm member 92 is connected to main post member 24. Alternatively, instead of using snap 94 a spring metal snap 95 can be utilized wherein snap 95 is inserted into the end of arm member 92 until its nipple mates with hole 97 in arm member 92.

In FIG. 4, arm member 32 has a round support extension 84 which passes through a round hole 82 in main post member 24. To keep support extension 84 from rotating in hole 82, a key 86 is provided on the surface of support extension 84. Additionally, a notch or key hole 81 is provided as an extension of hole 81 to accommodate key 86. Further, support extension has a threaded end portion 88 onto which is screwed an end cap 80, having threads 90 therein, to secure arm member 32 to main post support 24.

As thus far described, the sign post can be extended to various widths and heights uses the various components described with respect to FIGS. 1–4. Several of these variations in the assemble sign post are further shown in FIGS. 10A–10E. Further details and their alternatives as well as alternative connections for various components of the sign post will now be discussed below.

Figure 5A:
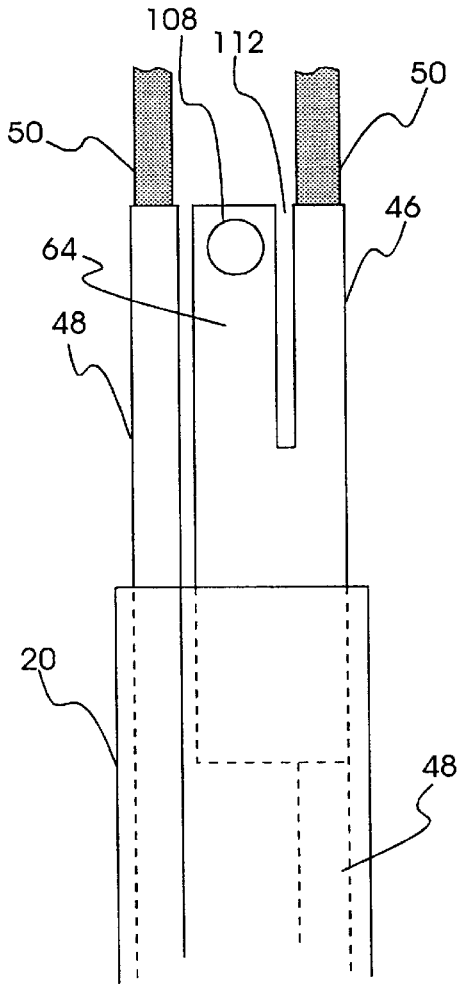
FIGS. 5A–5C show the snaps used in connecting the components of the sign post.

FIG. 5A is a more detailed view of a portion anchor post member 24. PVC angle 46 has a notch 122 cut therein. The edge of angel 46, which is adjacent pipe 48, and notch 112 form the boundaries of clip 64 which includes a nipple 108 between the edge of angel 46, which is adjacent pipe 48, and notch 112.

Figure 5B:
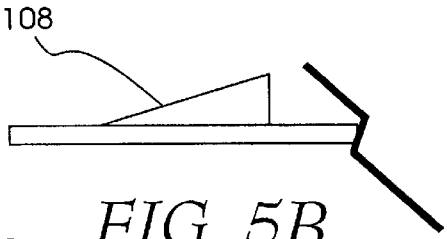
Figure 5C:
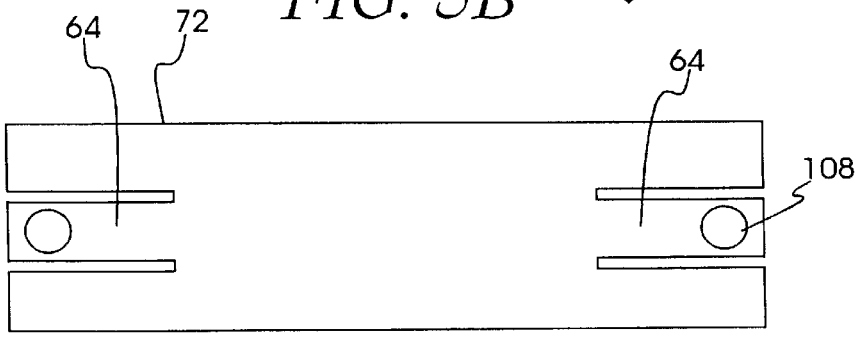

In FIG. 5B nipple 108 is shown as having a wedge shape. This shape facilitates the assembly process by requiring a minimal amount of force to be exerted when pushing the components of the sign post together. Each clip of the sign post has this wedge shape FIG. 5C shows a bottom view of coupling extension 72 shown in FIG. 2, wherein each end thereof has a clip 64 utilizing nipple 108 of FIG. 5B.

Figure 6A:
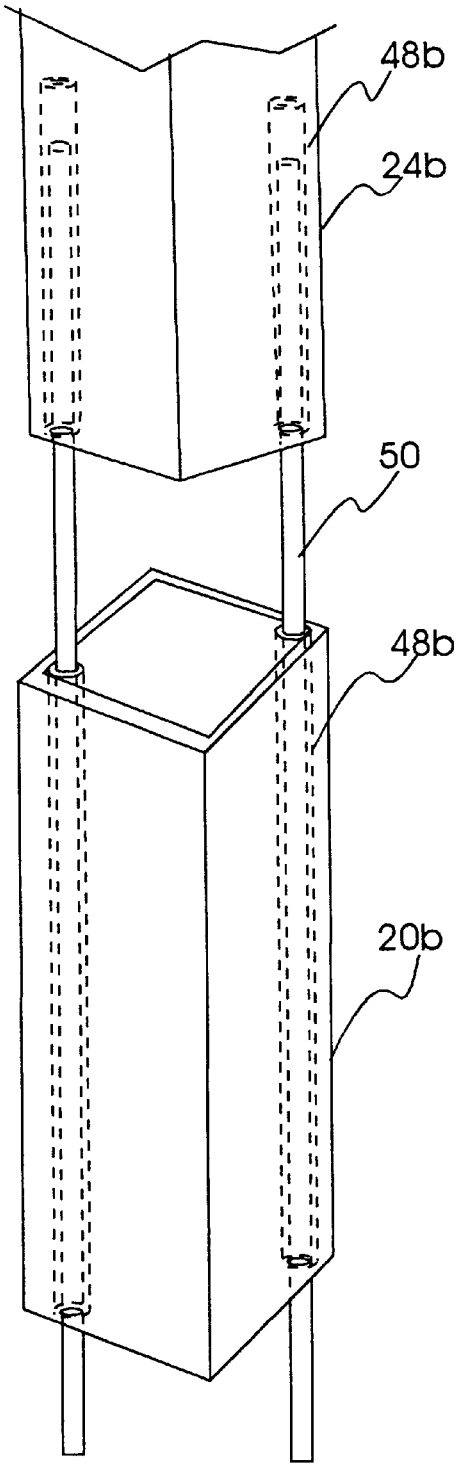
FIGS. 6A–6B show alternate anchoring systems to which the main post is attached and secured to the ground.

Referring now to FIG. 6A, an anchor post member 20*b* has two PVC pipes 48*a* of the same length as anchor post member 20*b* secured in diagonally opposite corners thereof, and main post member 24*b* has two PVC pipes 48*a* of predetermined length secured in diagonally opposite corners thereof. Here, main post member 24*b* and 20*b* are both either 3×3 or 4×4 PVC tubes. Stakes 50 are driven into the ground through pipes 48*a* and then pipes 48*b* are slid over the portions of stakes 50 not enclosed by pipes 48*a*, thereby assembling main post member 24 and anchor post member 20*b*.

Figure 6B:
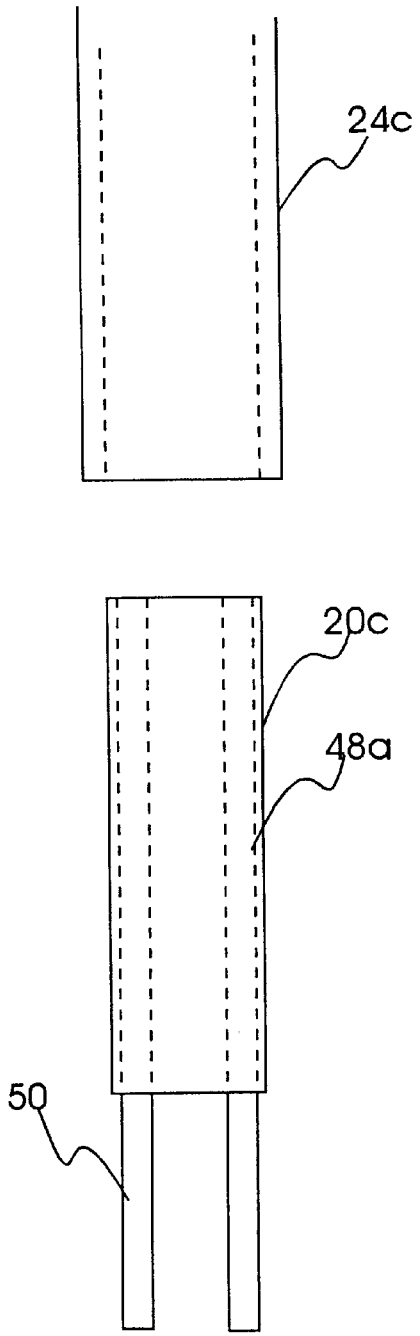

In FIG. 6B stakes 50 do not extend above anchor post member 20*c* and there are no pipes in main post member 24*c*. Here, main post member 24*c* is larger than anchor post member 20*c*. Once anchor post member 20*c* is secured to the ground by stakes 50 driven through pipes 48*a*, main post member 24*c* is slid over anchor post member 20*c*, with the inner walls of main post member 24*c* engaging the outer walls of anchor post member 20*c*.

Figure 7A:
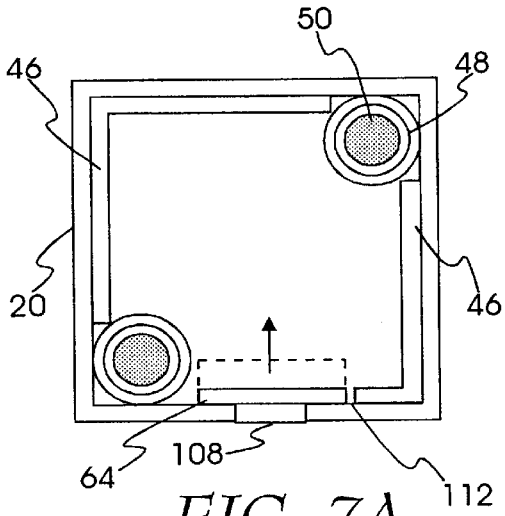
FIGS. 7A–7F show variations of the inner portion of the anchor post in relation to the stakes used to secure the anchor post to the ground.
Figure 7B:
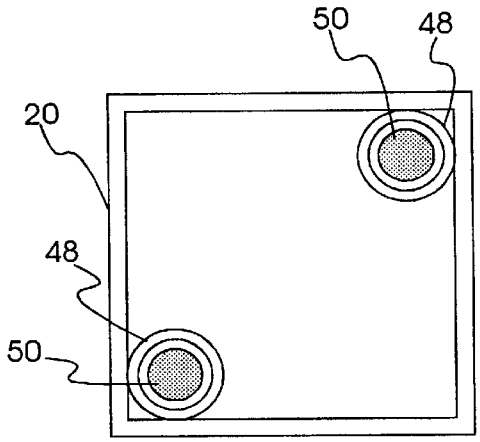
Figure 7C:
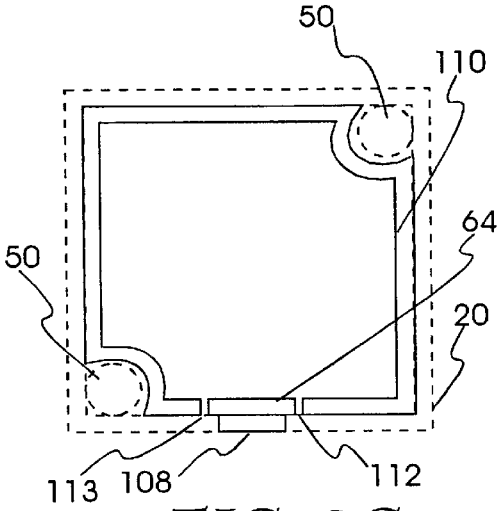
Figure 7D:
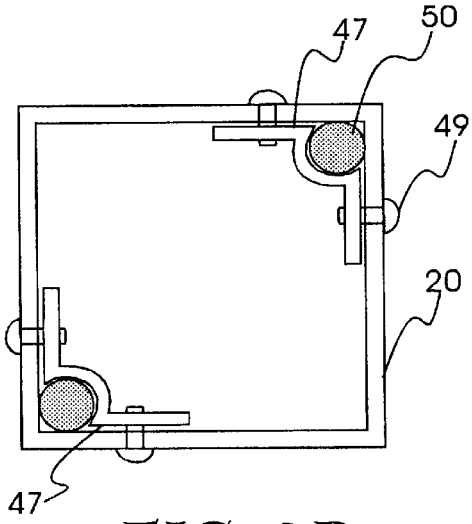
Figure 7E:
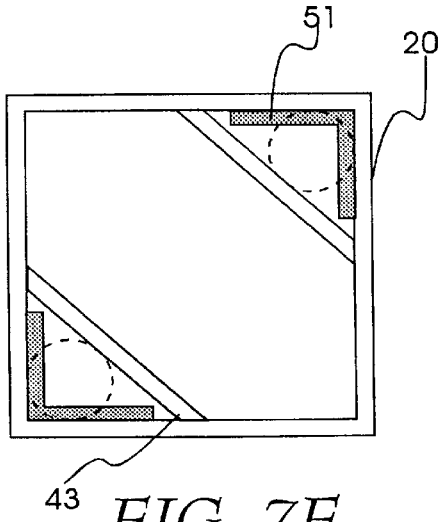
Figure 7F:
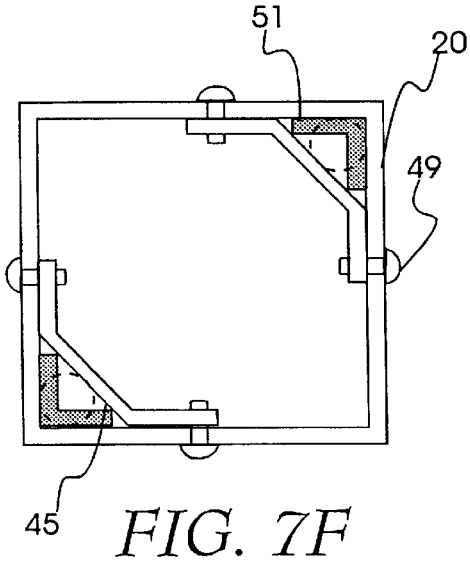

FIGS. 7A–7F illustrate various arrangements within the anchor post member which secure the anchor post member to stakes driven into the ground. FIG. 7A shows anchor post member 20 as described earlier with respect to FIGS. 2 and 5A. Anchor post member 20 has a pair of PVC pipes 48 glued into diagonally opposite corners and a pair of PVC angles 46 glued into the other diagonally opposite corners. One of the PVC pipes 46 has a clip 64, formed by notch 112 and nipple 108, formed therein. In FIG. 7B, anchor post member 20 has only a pair of PVC pipes 48 glued into diagonally opposite corners, as similarly shown in FIGS. 6A and 6B. In FIG. 7C the anchor post member 20 is shown by the dotted outline. Insert 110 is molded as a single unit and fits tightly into anchor post member 20 so that it is not necessary to glue insert 110 to anchor post member 20, and forms a male connector extension similar to that shown in FIG. 2. Here, clip 64 is formed by cutting two notches 112 and 113 into insert 110 and securing nipple 108 to that portion of insert 110 between the two notches 112 and 113. In FIG. 7D cove molded PVC brackets 47 of predetermined length are secured by rivets 49 in diagonally opposite corners of anchor post member 20. FIGS. 7A through 7D illustrate the utilization of metal rebars 50, however, it is also possible to use angle irons as stakes instead rebars 50, as shown in FIGS. 7E and 7F. In FIG. 7E a pair of PVC plates 43 are secured in diagonally opposite corners to form triangles through which angle irons 51 are driven into the ground. In FIG. 7F a pair of flat bottomed V shaped PVC plates 45 are secured by rivets 49 in diagonally opposite corners to form triangles through which angle irons 51 are driven into the ground.

Figure 18B:
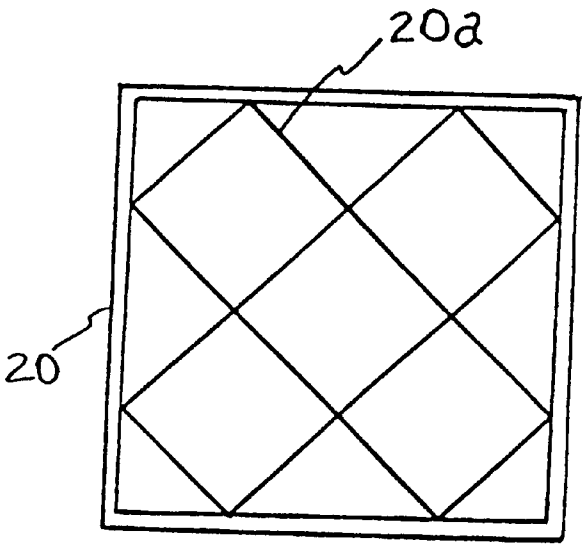
FIGS. 18A and 18B show a portion of an anchor post assembly including an achor post and a molded insert therein according to an alternative embodiment of the present invention.
Figure 18A:
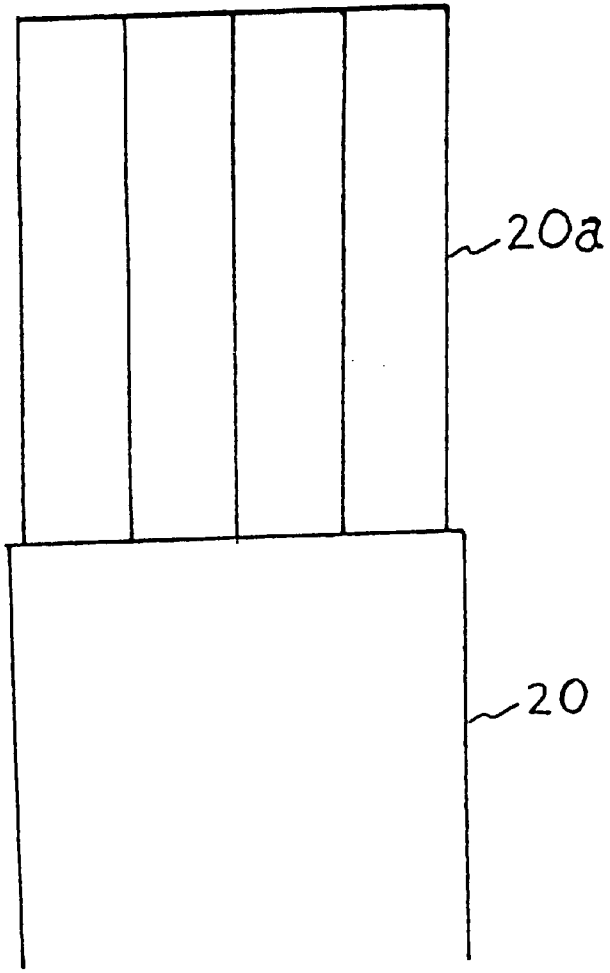
Figure 19A:
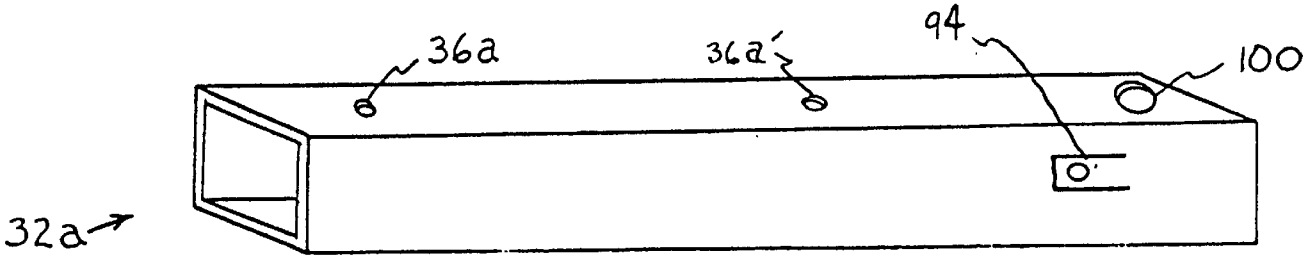
FIGS. 19A–19D illustrate alternative embodiments of the sign post arm.
Figure 19B:
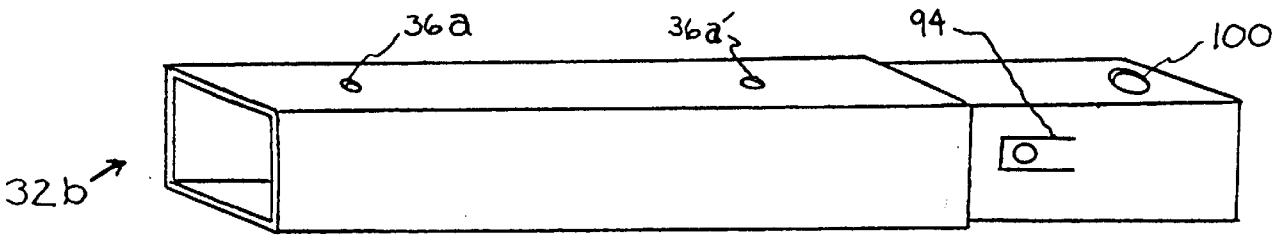
Figure 19C:
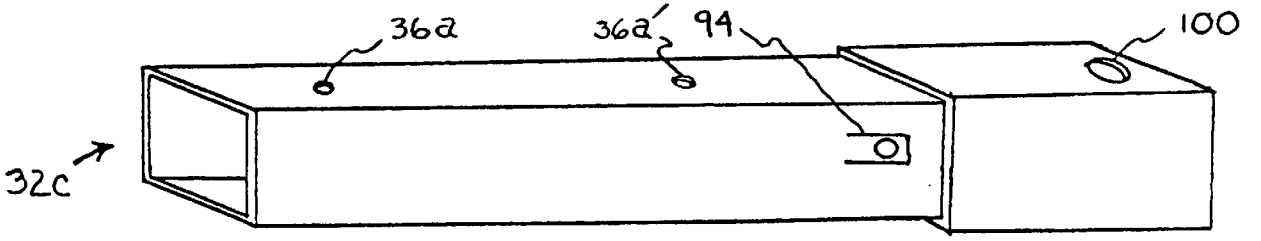
Figure 19D:
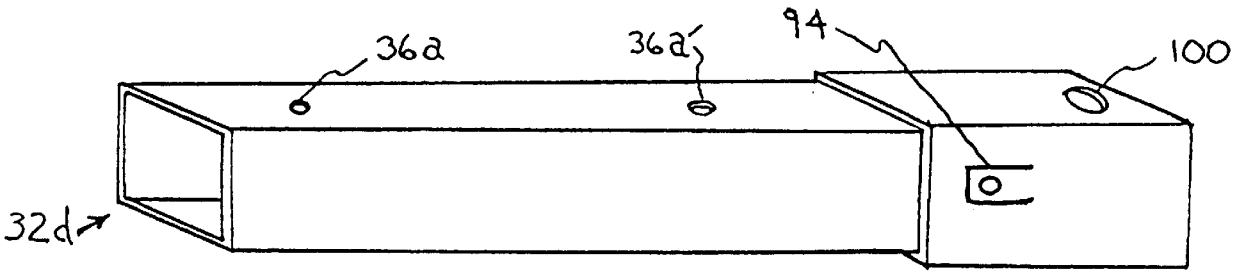

Referring now to an anchor post assembly shown in FIG. 18A, a molded insert 20*a* is shown extending above an upper portion of anchor post 20. The molded insert will have a shape as shown in FIG. 18B and is longer than anchor post 20. Accordingly, the main post can be slid over that portion of molded insert 20*a* when assembling the sign post kit. The shape of molded insert 20*a* as shown in FIG. 18B allows the user to insert stakes through any two of the 13 compartments (hollow areas) shown, but are preferably inserted through any two of the diagonally opposed sguare shaped compartments for greater stability and a stronger anchor post assembly. The numerous compartments provide the user flexability in selecting a ground area devoid of rocks, roots, etc., in which to drive the stakes.

Figure 8A:
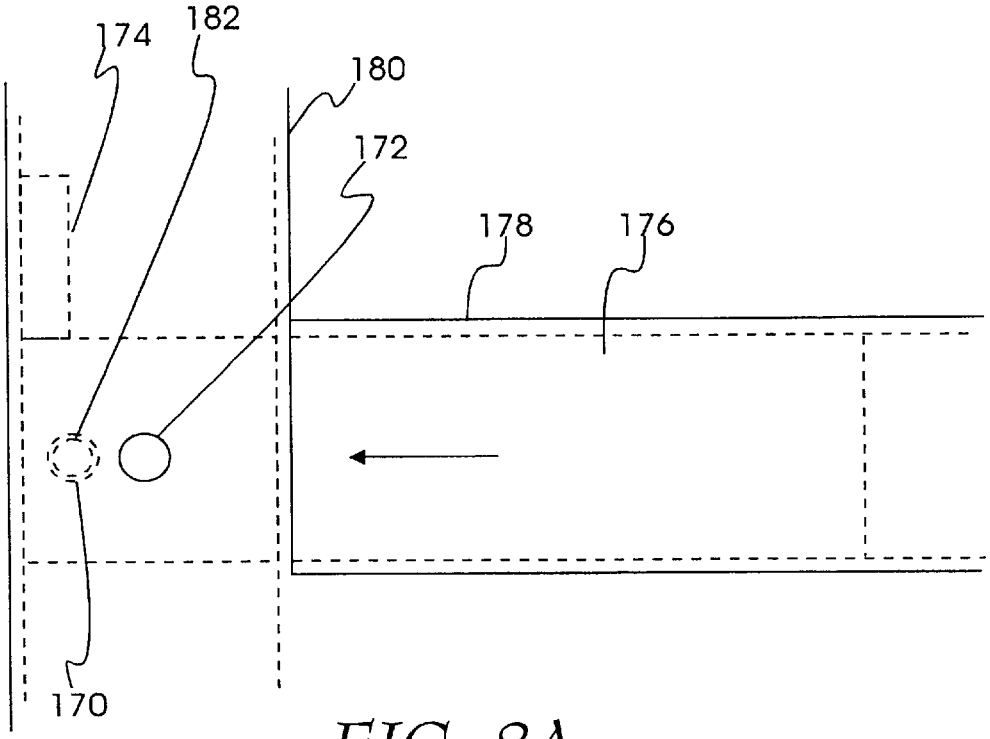
FIGS. 8A–8C are alternative arm and main post connections wherein the arm extends from only one side of the main post.
Figure 8B:
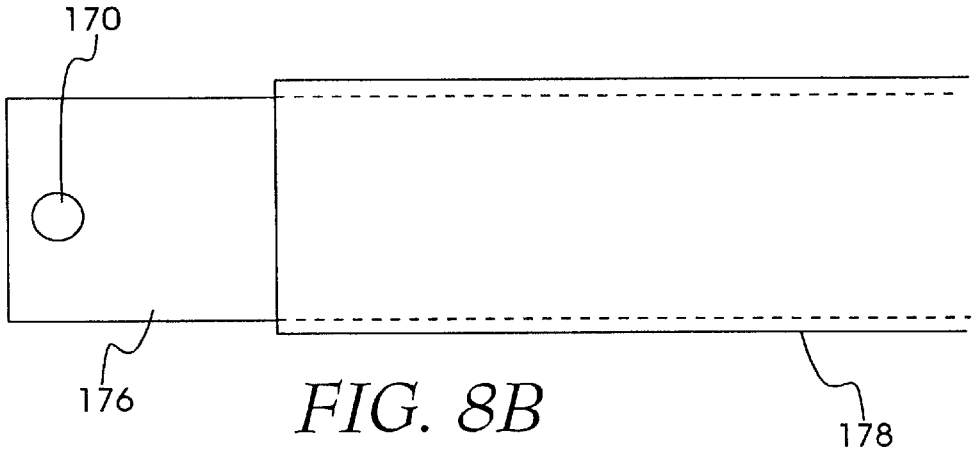
Figure 8C:
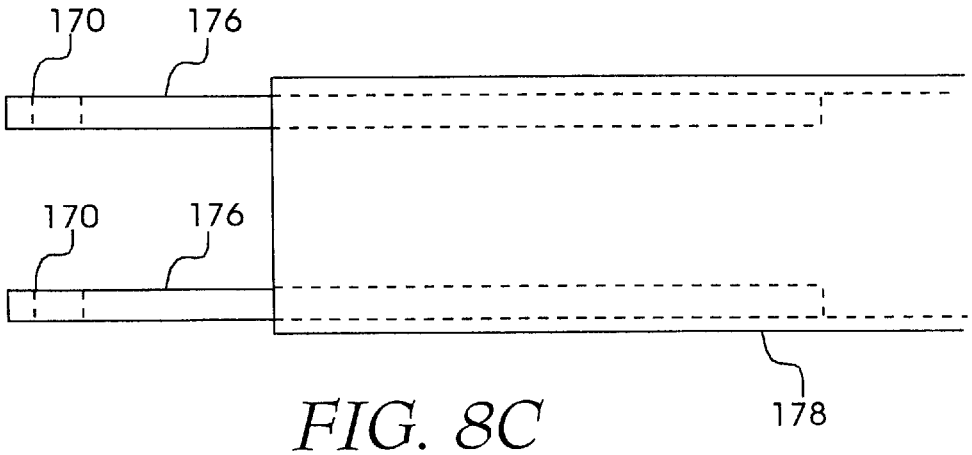

FIG. 10E shows a sign post which is assembled using the components described with respect FIGS. 8A–8C. In FIG. 8A main post member 180 has a pair of slots (not shown, see FIG. 2) therein to receive support extensions 176 of arm member 178. Extensions 176 have holes 170 therein, see FIG. 8B, which snap over wedge shaped nipples 182 secured to the inside wall of main post member 180. Note that extensions 176 are adhered to the inside walls of arm member 178 as shown in FIG. 8C. Again referring to FIG. 8A, holes 172 are provided in main post member 180 so that extensions 176 can be pressed inward to disengage nipple 182 and hole 170 in order to disassemble the sign post. There is also shown in FIG. 8A a support block 174 secured to the back wall of main post member 180 takes some of the stress off of hole 170 and nipple 182 when arm member 178 and main post member 180 are assembled.

Figure 9:
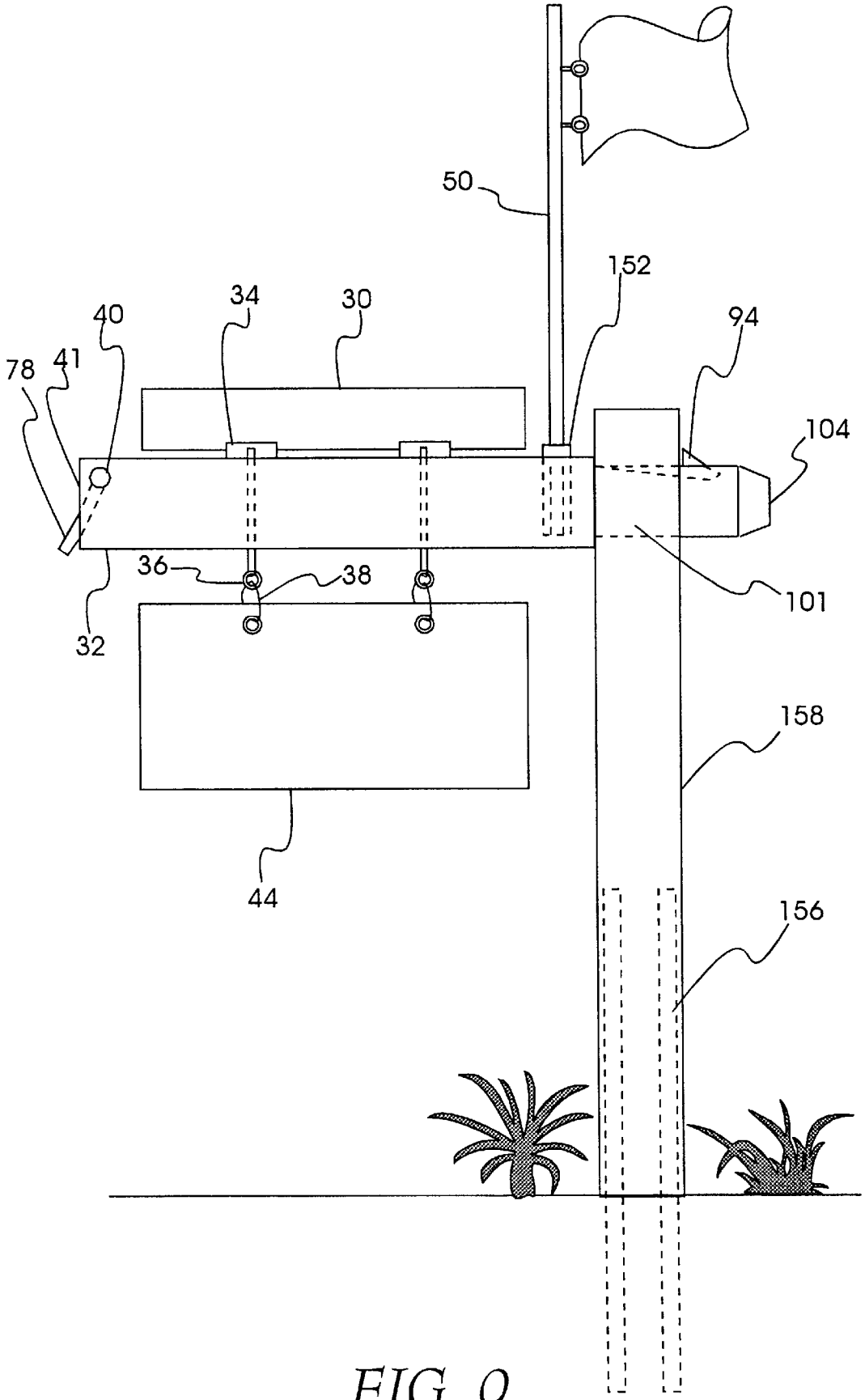
FIG. 9 illustrates a miniature sign assembled according to the principles of the present invention.

FIG. 9 is a mini sign, approximately 46 inches tall. Main post member 158 has two PVC pipes 156 secured in diagonally opposite corners which slide over stakes 50 already driven into the ground. Arm member 32 is constructed generally the same as described in FIGS. 1 and 2 in that it incorporates sign 44 hung below arm member 32 by rings 38 looped through eye bolts 36 extended through arm member 32 which attach sign support brackets 34 to arm member 32, wherein sign support brackets 34 are F shaped and serve as nuts for eye bolts 36 and also support message rider 30, and brochure box end 41 covered by a flap 78 hinged through holes 40 in arm member 32. Arm member 32 also incorporates support extension 101, snap 94 and end cap 104 discussed above with respect to FIG. 3. It is clear, however, that main post member 158 and arm member 32 can be snapped together using any of the support extensions described previously. Note that standard 50 is now mounted on arm member 32 having a flag pole holder 152 therein.

Figure 11:
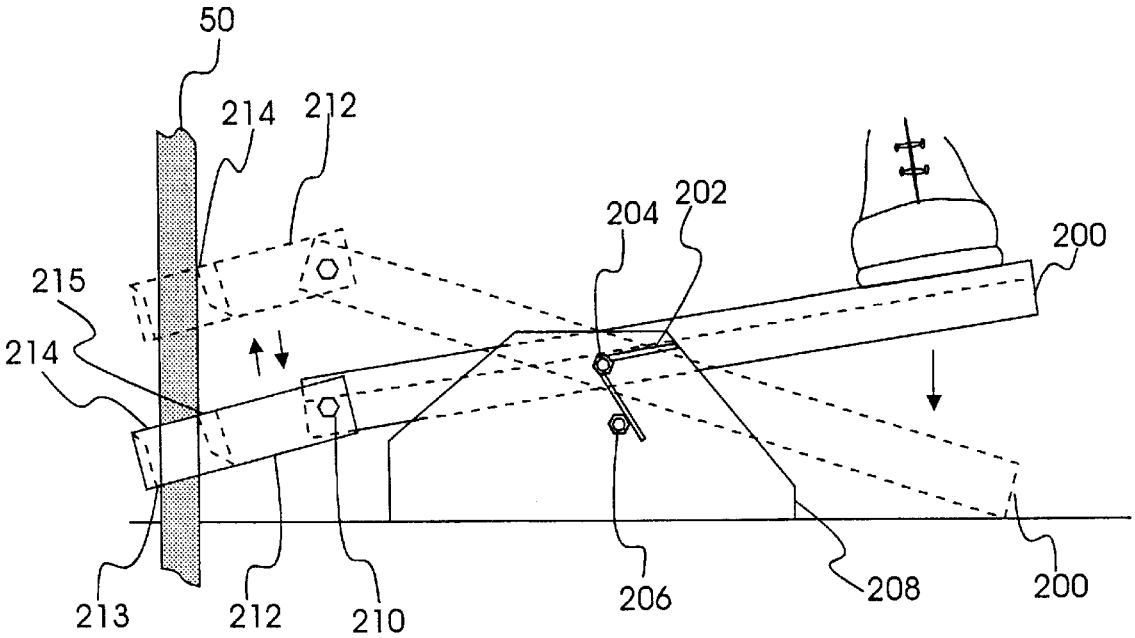
FIGS. 11–14 illustrate variations on a foot actuated stake pulling jack constructed according to the principles of a first embodiment of the present invention.
Figure 12:
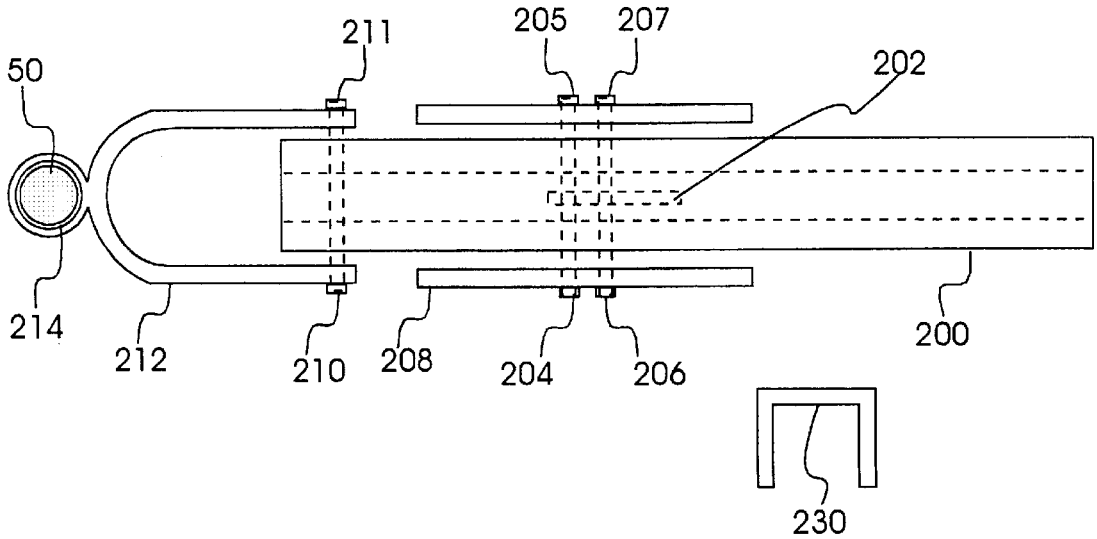

As mentioned earlier, stakes 50 are driven into the ground, and as such may be hard to remove. Accordingly, the sign post assembly constructed according to the principles of the present invention utilizes a device, i.e., a foot peddle jack, for easily removing these stakes will now be discussed with respect to FIGS. 11–17. In FIGS. 11 and 12 grooved lever 200 is attached to a flat bottomed U shaped base 208 using a bolt 204 and nut 205 tightened to allow rotation of lever 200 around bolt 204. Bolt 204 also passes through an eye of torsion spring 202 to hold it in place, wherein one arm of spring 202 abuts groove 230 in lever 200 and the other arm of spring 202 abuts a bolt 206 passed through base 208 and held in place by nut 207. Spring 202 biases lever 200 upwards when pressure from an operator's foot is removed. An eye fork 212 having an eye 214 is attached to lever 200 by bolt 210 and nut 211 to one end thereof in a manner to allow eye fork 212 to rotate with respect to lever 200. Eye 214 has two squared rim edges 213 and 215 which grab stake 50 when pressure is applied to the opposite end of lever 200. As further pressure is applied to lever 200, causing lever 200 to rotate to the position indicated by the dotted lines, eye 214 raises stake 50. When foot pressure is removed, spring 202 returns lever 200 to its starting position causing eye 214 to release and slide down stake 50.

Figure 13:
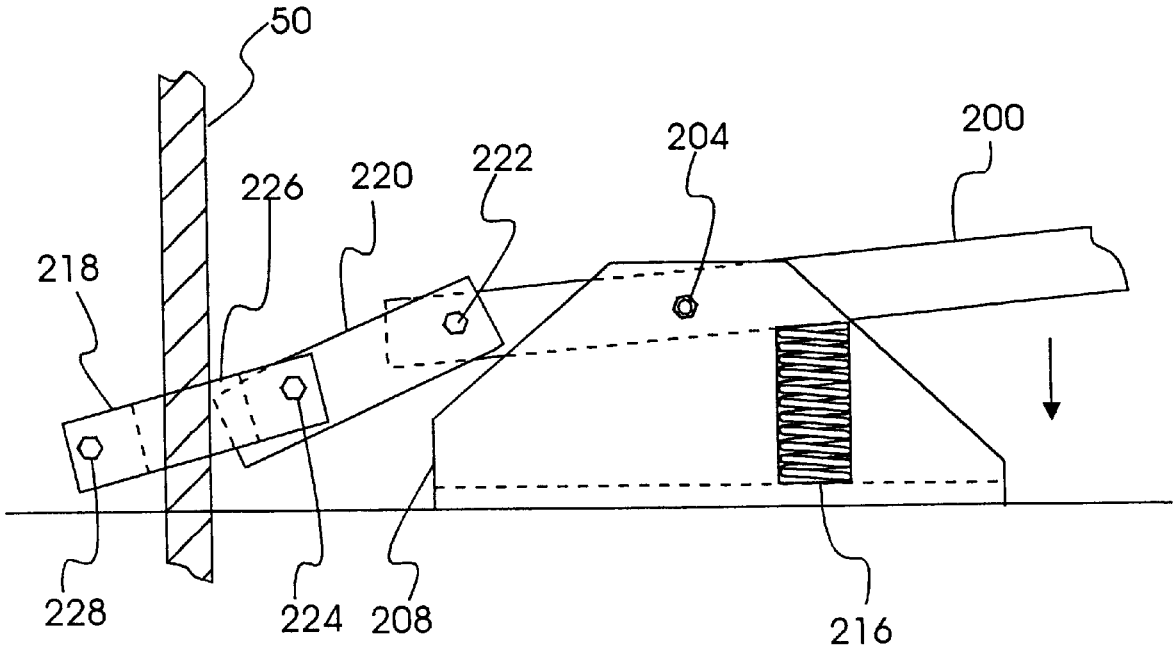
Figure 14:
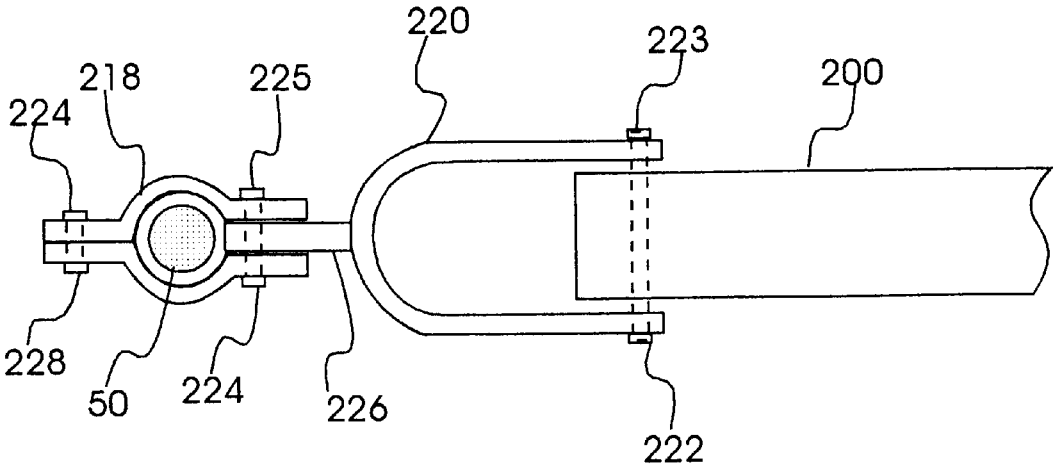

Referring now to FIGS. 13 and 14, a spiral compression spring 216 is used instead of torsion spring 202 of FIG. 11. Spring 216 is held in place by nipples (not shown) in groove 230 and on base 208. The stake pulling end of lever 200 has a fork 220 rotatably attached thereto by bolt 222 and nut 223. Two curved plates 218 are rotatably attached at one end to extension 226 of fork 220 by bolt 224 and nut 225. The opposite ends of plates 218 are fastened together by bolt 228 and nut 229. Plates 218 are flat on each end and curved in the middle, wherein the curved portions surround stake 50 and can also be used to surround an angle iron stake. Accordingly, when necessary, bolt 228 and nut 229 can be loosened to allow plates 218 to be placed around a stake. The action of the jack in FIG. 13 is the same as that of FIG. 11 except that instead of rim edge 215 of eye 214 of FIG. 11 grabbing the stake, the edge of the end of extension 226 of fork 220 grabs the stake.

Figure 15:
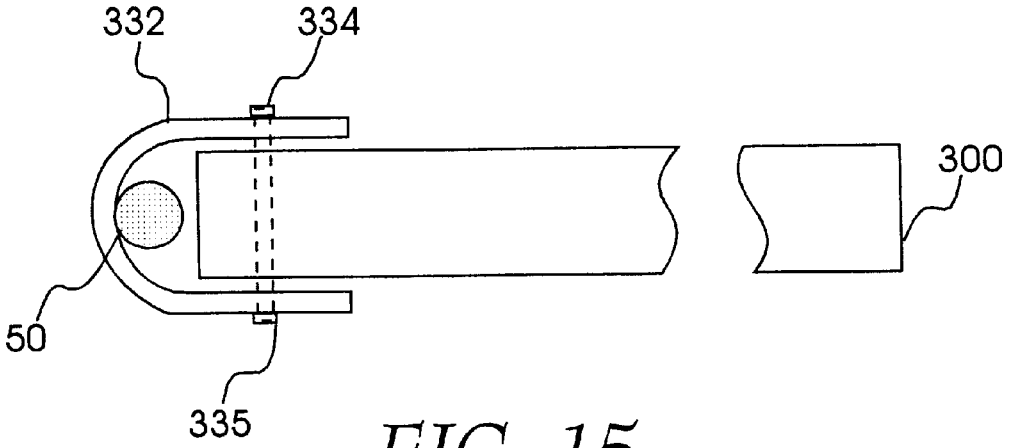
FIGS. 15–16 illustrate a hand actuated stake puller constructed according to the principles of a second embodiment of the present invention.
Figure 16:
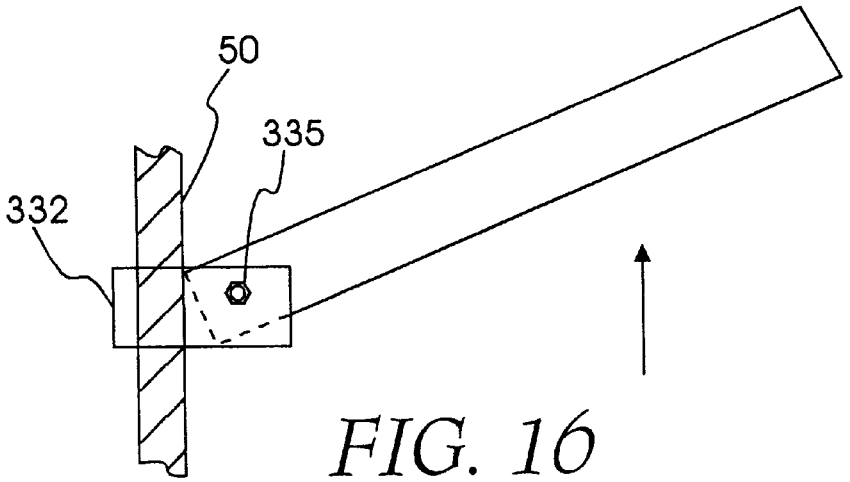

Alternatively, a hand jack, as shown in FIGS. 15 and 16, has a hand held lever 300 with a U-bar 332 rotatably attached thereto by bolt 334 and nut 335. Here, the operator raises the far end of lever 300 while pushing down the end nearest stake 50 thereby enabling lever 300 and U-bar 332 to grip stake 50. Once the jack has a grip on the stake the operator will then push and pull the jack to rotate the stake while pulling up the far end of lever 300, thereby loosening the stake from the ground.

Figure 17:
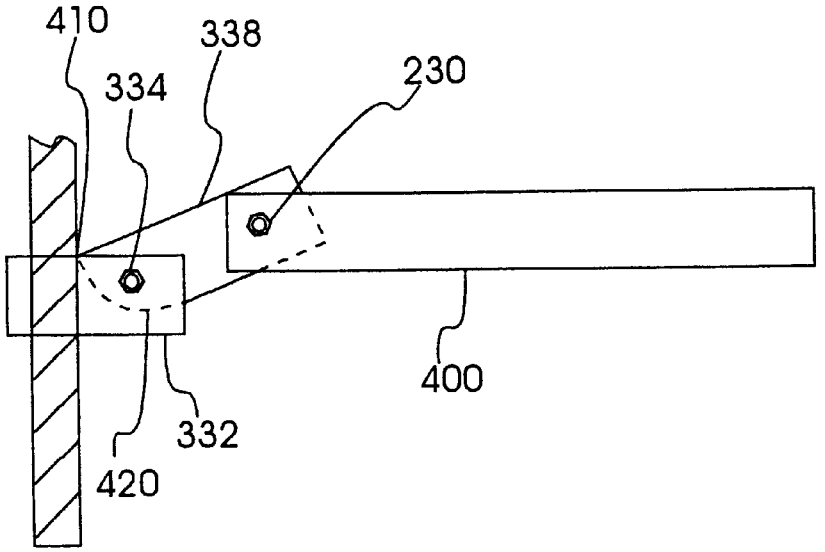
FIG. 17 illustrates an alternative lever arrangement for use with the jack of FIGS. 11–14.

In FIG. 17, the U-bar of FIG. 15 is attached to a link 338 by a nut and bolt 334, wherein link 338 has a squared edge 410 which engages with stake 50 and a rounded edge 420 to prevent the jack from binding when sliding U-bar 332 down the shaft of the stake. Link 338 is rotatably attached to a lever 400, which is similar to lever 200 of FIG. 11 except that there is a notch cut in the attaching end to accept link 338. Lever 400 is used as a foot lever and thus is attached to base 208 of FIG. 11.

Illustrated in FIGS. 19A–19D are alternative arms 32*a*–32*d*, respectively, having holes 36*a* through which eye bolts 36 are passed, snaps 94 which engage with snap receiving means in the main post, and flag post holes 100 for receiving a flag post. Although not shown, it is understood that the ends, oriented towards the left as viewed in the drawings, will comprise means for enabling a flap (see 78 in FIG. 1) to be attached thereto.

Figure 20:
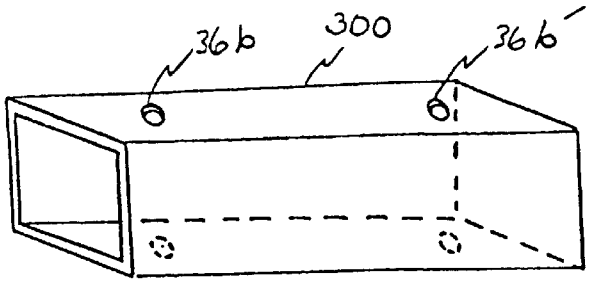
FIG. 20 shows an alternative embodiment of an arm member extension according to the principles of the present invention.

FIG. 20 shows an arm member extension 300 having holes 36*b* and 36*b*' therein through which the eybolts are passed when connecting two arms of two corresponding sign post kits. Holes 36*b* and 36*b*' will lign up with holes 36*a* of the arms and the eyebolts will pass through both the arm and extension 300. The shape of extension 300 is such that it can be inserted into the arms, or the shape is such that the arms can be inserted into extension 300.

Figure 21A:
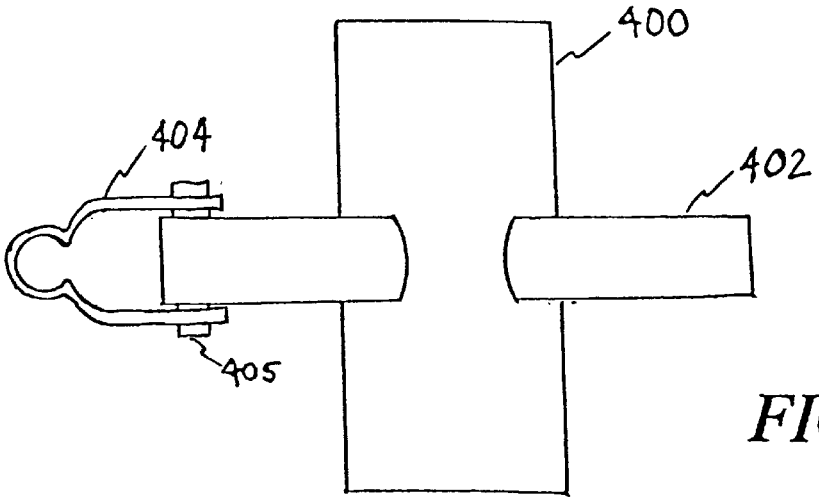
FIGS. 21A and 21B illustrate respective top and side views of a foot actuated stake pulling jack constructed according to the principles of a second embodiment of the present invention.
Figure 21B:
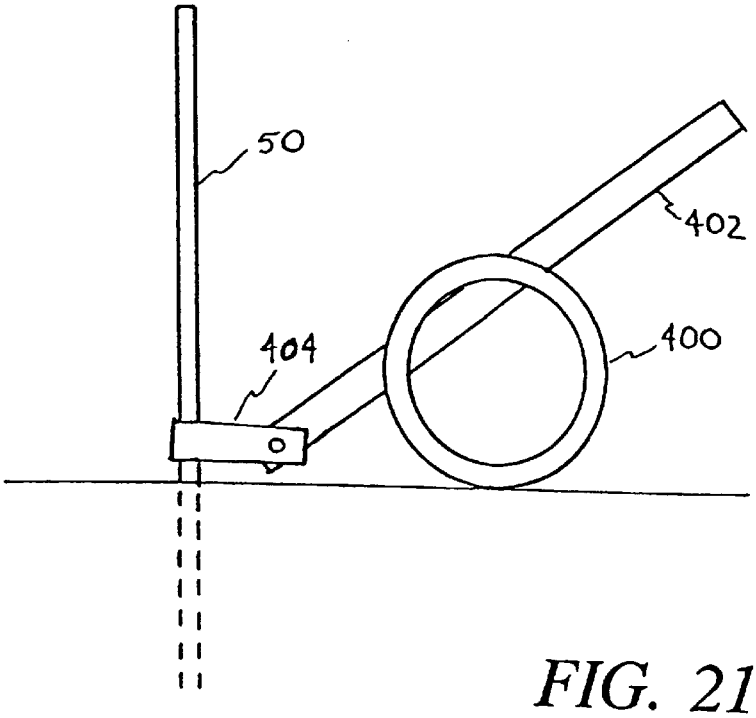

FIGS. 21A illustrates a top view of a foot actuated stake pulling jack having a foot actuated lever 402 passing through a tube 400. Tube 400 acts as the fulcrum for lever 402. An eye fork 405 is attached to lever 402 by a bolt 405. FIG. 21B illustrates a side view of the foot actuated stake pulling jack and shows that lever 402 passes through an upper portion of tube 400. Tube 400 is contructed of a light weight material such as a hard grade PVC pipe, lever 402 is contructed from galvanized pipe, and eye fork 405 is constructed from galvanized metal.

The sign post kit has been described according to the preferred embodiments, however, it will readily be understood that the present invention is susceptible to a broad utility and application. Many embodiments, adaptations, variations, modifications and equivalent arrangements will be apparent or reasonably suggested by the present invention and foregoing description thereof, without departing from the scope of the present invention. For example, each snap could be formed from a metal spring simular to snap 95 in FIG. 3B. Additionally, a sleeve having the alternative messages such as the word "FLYER" on opposite sides and the word "SOLD" on the other sides can be provided such that the sleeve will slide over the end of the arm. Further, a carrying case can be provided in which all the components for one sign post kit will fit to enable the kit to be easily carried. Accordingly, the foregoing disclosure is not intended to be construed to limit the present invention, the present invention only being limited by the claims appended hereto and the equivalents thereof.

What is claimed:

1. A sign post kit comprising:

an anchor post having two stake receiving means in diagonally opposite corners therein for slidably engaging a pair of stakes, said stakes being driven into the ground through said stake receiving means;

a first snap formed utilizing a portion of a sidewall of said anchor post and extending above a surface of said portion of said sidewall;

a main post having a first snap receiver extending through a sidewall of said main post for receiving said first snap to assemble said main post to said anchor post;

an arm for supporting a sign, said arm having a second snap formed utilizing a portion of a sidewall of said arm and extending above said portion of said sidewall of said arm for enabling said arm to be assembled to said main post;

a second snap receiver extending through said sidewall of said main post for receiving said second snap to mount said arm to said main post; and a jack for removing said stakes from the ground.

2. The sign post kit as set forth in claim 1, said stake receiving means comprising a pair of pipes adhered to respective ones of said diagonally opposite corners.

3. The sign post kit as set forth in claim 1, said stake receiving means comprising a pair of molded plates riveted to respective ones of said diagonally opposite corners.

4. The sign post kit as set forth in claim 1, said stake receiving means comprising pair of plates adhered to respective ones of said diagonally opposite corners to form triangular openings for receiving stakes made of angle irons.

5. The sign post kit as set forth in claim 1, said arm further comprising:

a pair of eye bolts extending through opposite sidewalls of said arm and secured to said arm by a respective pair of F shaped brackets, said eye bolts enabling a sign to be hung from said arm and said F shaped brackets enabling a rider sign to be supported on top of said arm;

one end of said arm forming a brochure compartment, said brochure compartment being enclosed by a flexible flap; and said one end of said arm having a pair of holes for receiving extensions of said flexible flap.

6. The sign post kit as set forth in claim 1, said second snap comprising support extensions secured to said arm, said support extensions passing through said main post.

7. The sign post kit as set forth in claim 1, said first and second snaps each comprising a wedge shaped nipple.

8. The sign post kit as set forth in claim 1, further comprising flag support means attached to an inside corner of said main post for supporting a banner.

9. A sign post kit comprising:

an anchor post having a molded insert therein, said molded insert forming at least two stake receiving means in said anchor post for slidably engaging a pair of stakes driven into the ground through said stake receiving means;

a first snap formed in a side component of said molded insert and extending above a surface of said side component;

a main post having first snap engaging means formed in a sidewall of said main post for receiving said first snap when assembling said main post to said anchor post;

an arm for supporting a sign, said arm having a second snap for enabling said arm to be assembled to said main post, said second snap being formed in a side component of said arm and extending above a surface of said side component of said arm;

second snap engaging means formed through a sidewall of said arm for receiving said second nap when assembling said arm to said main post; and a jack for removing said stakes from the ground.

10. The sign post kit as set forth in claim 9, said main post having an opening through which said arm is passed until said second snap engages said second snap engaging means.

11. The sign post kit as set forth in claim 9, said arm further comprising:

a pair of eye bolts extending through said arm and secured to said arm by a respective pair of F shaped brackets, said eye bolts enabling a sign to be hung from said arm and said F shaped brackets enabling a rider sign to be supported on top of said arm;

one end of said arm forming a brochure compartment, said brochure compartment being enclosed by a flexible flap; and said one end of said arm having a pair of holes for receiving extensions of said flexible flap.

12. The sign post kit as set forth in claim 9, further comprising:

coupling means for enabling an assembled second sign post kit to be connected to said arm.

13. A sign post kit comprising:

an anchor post having a molded stake receiving means therein for slidably engaging a pair of stakes, said stakes being driven into the ground through said stake receiving means;

a main post for slidably engaging said molded stake receiving means when connecting said main post to said anchor post;

an arm for supporting a sign, said arm having a flexible snap formed from a portion of a sidewall of said arm and extending above said portion of said sidewall for engaging with a snap receiving means in said main post as said arm is passed through a pair of square openings in opposite sidewalls of said main post when assembling said arm to said main post; and a jack for removing said stakes from the ground.

14. The sign post kit as set forth in claim 13, said jack comprising:

a base for pivotally supporting a lever in a first position; and gripping means rotatably attached to said lever and positioned around one of said stakes, said gripping means securely grabbing said stake when said lever is forced to a second position.

15. The sign post kit as set forth in claim 14, said gripping means comprising:

an eye fork having an eye which is positioned around said stake.

16. The sign post kit as set forth in claim 14, said gripping means comprising:

a pair of curved plates rotatably connected to an extension of a fork, said fork being rotatably connected to said lever;

said pair of curved plates being bolted together to form an opening which, in combination with said extension of said fork, surrounds said stake.

17. The sign post kit as set forth in claim 14, wherein said base has a tubular shape and said lever extends non-diametrically through said base.

18. The sign post kit as set forth in claim 14, wherein said base is formed from an elongated cylindrical tube and said lever passes through sidewall portions of said elongated cylindrical tube.

19. The sign post kit as set forth in claim 13, said molded stake receiving means comprising more than two selectable guides for receiving said stakes.

20. The sign post kit as set forth in claim 19, wherein there are at least five selectable guides and each of said five selectable guides have a square cross section.

* * * * *